US009010263B2

(12) United States Patent
Kuhlmann

(10) Patent No.: US 9,010,263 B2
(45) Date of Patent: Apr. 21, 2015

(54) DEVICE FOR MANEUVERING A WATERCRAFT

(71) Applicant: Becker Marine Systems GmbH & Co. KG, Hamburg (DE)

(72) Inventor: Henning Kuhlmann, Hamburg (DE)

(73) Assignee: Becker Marine Systems GmbH & Co. KG, Hamburg (DE)

( * ) Notice: Subject to any disclaimer, the term of this patent is extended or adjusted under 35 U.S.C. 154(b) by 245 days.

(21) Appl. No.: 13/653,564

(22) Filed: Oct. 17, 2012

(65) Prior Publication Data

US 2013/0092070 A1 Apr. 18, 2013

(30) Foreign Application Priority Data

Oct. 17, 2011 (DE) ..... 10 2011 054 520
Feb. 13, 2012 (EP) ..... 12155107

(51) Int. Cl.
*B63H 25/06* (2006.01)
*B63H 25/08* (2006.01)
*B63H 25/38* (2006.01)

(52) U.S. Cl.
CPC ..... *B63H 25/08* (2013.01); *B63H 25/38* (2013.01)

(58) Field of Classification Search
CPC ..... B63H 25/38
USPC ..... 114/162, 165, 169
See application file for complete search history.

(56) References Cited

U.S. PATENT DOCUMENTS 7,591,230 B2 * 9/2009 Kluge et al. ..... 114/162

FOREIGN PATENT DOCUMENTS

| | | | |
|---|---|---|---|
| CN | 1891571 | A | 1/2007 |
| DE | 202005013583 | U1 | 11/2005 |
| DE | 202007012480 | U1 | 11/2007 |
| EP | 0579533 | A1 | 1/1994 |
| EP | 2033891 | B1 | 10/2009 |
| JP | 2007-008440 | A | 1/2007 |
| JP | 2009-062028 | A | 3/2009 |
| KR | 10-2009-0025125 | A | 3/2009 |
| TW | 200911627 | A | 3/2009 |

* cited by examiner

*Primary Examiner* — Edwin Swinehart
(74) *Attorney, Agent, or Firm* — Kelly & Kelley, LLP

(57) ABSTRACT

A device for maneuvering a watercraft includes a rudder trunk and a receiving shaft, wherein a first part of the rudder trunk is disposed in the receiving shaft in such a manner that there is an intermediate space between the first part of the rudder trunk and a wall of the receiving shaft. A second part of the rudder trunk projects from the receiving shaft, wherein the intermediate space has an apparatus for clamping the first part of the rudder trunk over a clamping height. A method for manufacturing a device for maneuvering a watercraft is also provided, wherein the manufacturing expenditure for the rudder trunk is reduced and the installation process of the rudder trunk is simplified.

23 Claims, 4 Drawing Sheets

DEVICE FOR MANEUVERING A WATERCRAFT

Figure 1:
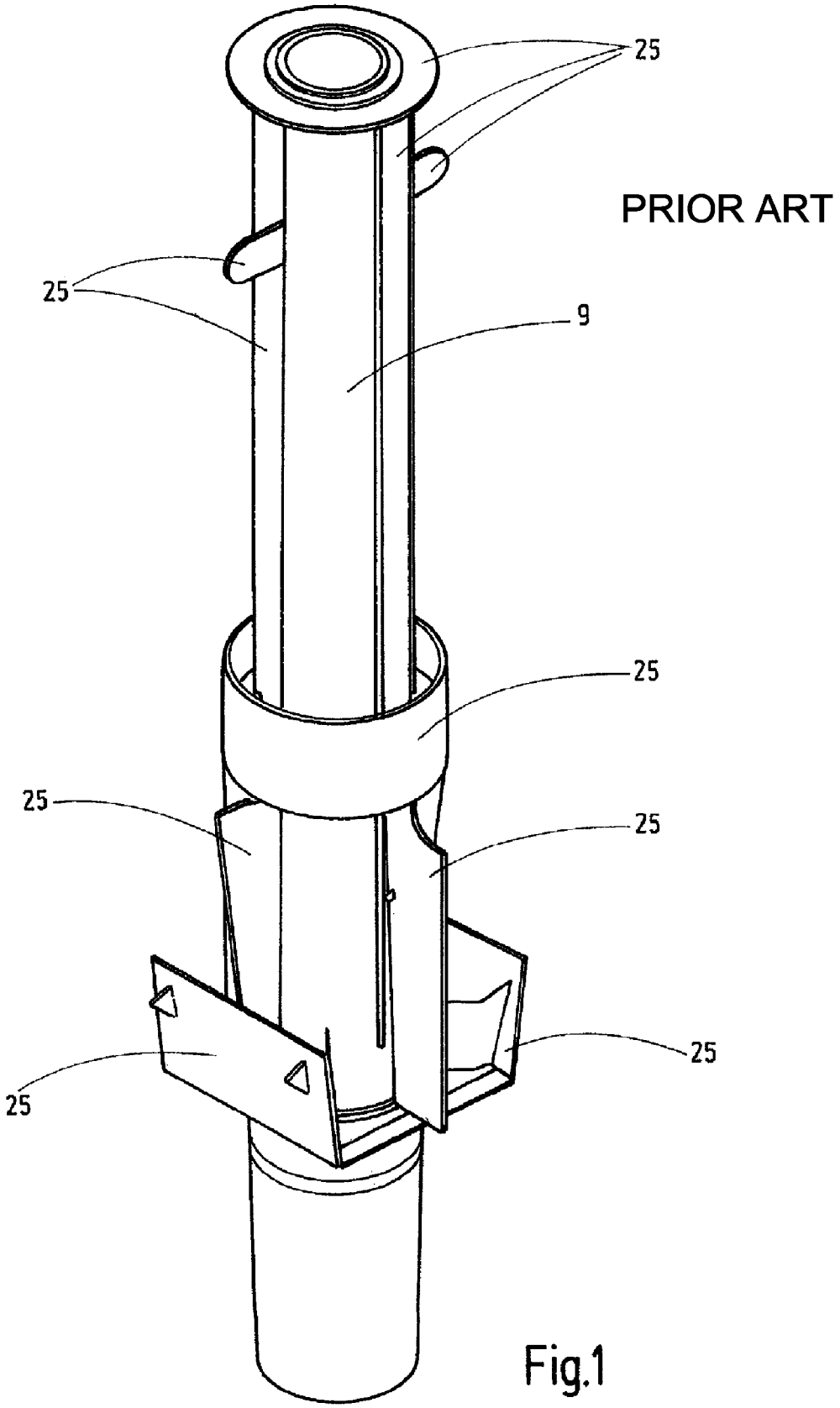

The invention relates to a device for maneuvering a watercraft comprising a rudder trunk and a receiving shaft.

The invention further relates to a method for producing a maneuvering device for a watercraft.

The mounting of large rudders, for example, in cargo ships or container ships in so-called rudder trunks is usually accomplished in structural components as bought-in components or as shipyard-built components of not inconsiderable size. Consequently, the rudder trunk of a rudder system is used for mounting the rudder stock and for transmission of the rudder forces into the watercraft. The mounting of the rudder stock in the rudder trunk can be accomplished by means of a so-called neck bearing which is designed as a plain bearing bushing. Such bearing bushings are usually inserted in the lower part of the rudder trunk. Furthermore, a second bearing can be provided which, for example is located at the upper end of the rudder trunk or in a rudder engine. Rudder trunks are introduced into the existing stern structure of the watercraft in order to introduce the resulting forces and moments of the rudder stock into the watercraft.

It is further known in order to minimise the costs for lubricant and to protect the environment to provide a so-called seawater lubrication. By providing for a seawater lubrication it is possible to lubricate the bearing points in the rudder trunk without using grease. In order to ensure that the water penetrating through the seawater lubrication does not enter into the ship, the rudder trunk must include a sealing system. Such sealing systems are usually located below the rudder engine deck and therefore seal the rudder stock towards the rudder trunk. The rudder trunk itself is furthermore welded in a watertight manner in order to prevent the ingress of water into the stern.

In conventional structures the rudder trunk is designed as a continuous steel tube. Usually the steel tube or the rudder trunk is connected to the ship structure by means of welding. For this various connection plates and struts must be attached to the rudder trunk to ensure sufficient introduction of forces. Such connection plates must agree exactly with those devices provided in the stern section at the shipyard, for example, connection plates in order to guarantee a rapid installation and the exact alignment of the trunk. However, as a result of the high introduction of heat during welding and the resulting welding distortion, a correct position is not always guaranteed. Furthermore, it must be ensured that the structure can introduce the resulting rudder forces into the ship structure and has sufficient safety in relation to externally acting forces such as swell, running aground etc.

Compared to the other components of the rudder system, the rudder trunk must be prepared for assembly relatively early on since the installation is accomplished with the first laying of the stern section. Furthermore, rudder trunks for larger freighters or container ships have a very high weight and a large length. For example, a rudder trunk made of steel, or a so-called steel trunk for a large container ship can have a length of over 10 m and a weight of about 20 tonnes. As a result of the large length and the high weight of such a steel trunk, the fabrication of the rudder trunk is associated with high material costs. Furthermore, high transport and storage costs must be reckoned with as a result of the large dimensions and the high weight.

FIG. 1 shows a rudder trunk 9 as is known from the prior art and usually used. The rudder trunk 9 shown in FIG. 1 is designed for a rudder system. The length of the rudder trunk 9 is defined in such a manner that it corresponds to the distance from the rudder hub to the rudder engine deck. Usually the rudder trunk 9 is fabricated in two separate parts. The function of the upper part of the rudder trunk 9 consists in particular in sealing the watercraft, e.g. the ship.

A plurality of connecting means, e.g. struts and/or connection plates 25, are provided on the rudder trunk 9. These connecting means are used to connect the rudder trunk 9 to the ship structure or the watercraft body (not shown here), in particular the structure of the stern. Usually these connecting means are welded to the watercraft body or parts of the ship structure.

In addition to the usual rudder trunks made of steel, which are connected to the ship structure by means of welding, a rudder trunk is already known from EP 2 033 891 B1 which is not connected to the ship structure by means of welding but is inserted in a so-called trunk tube and then cast or bonded. In this case, the rudder trunk is not made of steel but from a fibre composite material.

It is the object of the invention to provide a device for maneuvering a watercraft and a method for producing a device for maneuvering a watercraft, where the fabrication expenditure for the rudder trunk is reduced compared with known rudder trunks and the installation process is simplified.

This object is solved by a device for maneuvering a watercraft according to the features of claim 1 and a method for producing a maneuvering device for a watercraft according to the features of claim 17.

According to this, the device designated above for maneuvering a watercraft comprises a rudder trunk and a receiving shaft. A first part, the upper part, of the rudder trunk is disposed in the receiving shaft and a second part, the lower part, of the rudder trunk projects downwards from the receiving shaft. The terms "top" or "upper" and "bottom" or "lower" relate to the state of the rudder trunk when built into a watercraft. In this context the rudder trunk is disposed in such a manner that there is an intermediate space between the first part or the upper part of the rudder trunk and the wall of the receiving shaft. The intermediate space is filled at least in certain areas with a connecting means, where the connecting means clamps the first part of the rudder trunk over a clamping height. In this case, the connecting means connects the first part or the upper part of the rudder trunk over the entire circumference of the first part of the rudder trunk to the wall of the receiving shaft, where the connecting means is disposed at least in the lower end region and in the upper end region of the clamping height. Consequently, "clamping height" is to be understood as the height over which the rudder trunk is clamped in the receiving shaft or over which the rudder trunk is connected to the wall of the receiving shaft. In order that the connecting means makes a connection between the rudder trunk and the wall of the receiving shaft over the entire circumference of the rudder trunk, the intermediate space must accordingly be configured surrounding the entire circumference of the rudder trunk. The clamping height therefore extends from the lowermost region in which the connecting means is provided between rudder trunk and the wall of the receiving shaft as far as the uppermost region in which the connecting means is provided between rudder trunk and the wall of the receiving shaft. At the same time, the intermediate space between the uppermost and the lowermost end region in which the connecting means between rudder trunk and the wall of the receiving shaft is disposed in each case can also be empty or without any connecting means disposed between rudder trunk and the wall of the receiving shaft and can therefore comprise a free space. For example, it is feasible that the connecting means is only provided in two regions, in the lowermost region and in the uppermost region of the clamping height and a free space is provided between these two regions. The lowermost region of the clamping height is, for example, the region in which the receiving shaft ends or terminates at the bottom and the rudder trunk projects downwards from the receiving shaft. The uppermost region of the clamping height is, for example, the region in which the rudder trunk inside the receiving shaft ends at the top. Consequently, this upper region of the clamping height lies below the rudder engine deck of the maneuvering device of the watercraft in the built-in state. For example, the rudder trunk could be disposed over half the height of the receiving shaft in the receiving shaft. In this case, the uppermost region of the clamping height in which the connecting means is disposed between the rudder trunk and the wall of the receiving shaft would be located approximately at half the height of the complete receiving shaft. Furthermore, however, the rudder trunk can be disposed over a smaller or greater height in the receiving shaft.

According to the invention, the length ratio of the clamping height to the second part of the rudder trunk is at least 1. Consequently, the region of the rudder trunk which is clamped in the receiving shaft or connected to the wall of the receiving shaft by the connecting means is at least as long as the part of the rudder trunk projecting downwards from the receiving shaft. Preferably the clamping height is at least the same length and at most three times as long as the downward-projecting part of the rudder trunk. It is further preferred that the ratio of the clamping height to the second part of the rudder trunk is between 1 and 2. In this case, the clamping height is at least as long as the second part of the rudder trunk, but at most twice as long as the second part of the rudder trunk.

In particular, the provision of the connecting means in the lower end region of the clamping height and in the upper end region of the clamping height and the length ratio according to the invention of the clamping height to the part of the rudder trunk projecting downwards from the receiving shaft, the second part of the rudder trunk, has the advantage that the fabrication expenditure of the rudder trunk can be reduced appreciably compared with conventional rudder trunks. Apart from the connecting means for connecting the rudder trunk to the wall of the receiving shaft, no further devices are required to connect the rudder trunk to the ship structure. The receiving shaft is already provided or incorporated in the ship structure or in the region of the watercraft body provided for this purpose at the shipyard based on the dimensions of the rudder trunk according to the invention. Furthermore, the installation process is consequently simplified. For example, in contrast to known rudder trunks, in the device according to the invention, the rudder trunk no longer needs to be provided so early for installation in the rudder system. In the device according to the invention, for example, it is sufficient to supply the dimensions and tolerances of the rudder trunk and merely provide the receiving shaft in the stern section at the shipyard at the time of construct of the stern structure. The actual installation of the rudder trunk can be accomplished by the device according to the invention at a later time.

The connecting means preferably comprises means for adhesive bonding. As a result, the rudder trunk is adhesively bonded to the wall of the receiving shaft. The rudder trunk is therefore in adhesive connection with the wall of the receiving shaft. The connecting means can consist of any connecting means which has adhesive properties. It could here comprise a resin or an epoxide-based casting material. For example, the connecting means could also comprise an epoxide resin such as Epocast or another assembly adhesive such as, for example, Belzona®. The connecting means is preferably mixed from a resin and a hardener. Consequently, the connecting means comprises a two-component system. It is particularly preferred that the connecting means consists of Belzona® 5811. Belzona® 5811 has sufficiently good adhesive properties so that by using Belzona® 5811 as connecting means, a suitable sealing of the gap or the intermediate space between rudder trunk and the wall of the receiving shaft, in particular in the upper and lower end regions of this intermediate space is given. The connecting means therefore preferably has such high adhesive properties that the device according to the invention does not tend to gap corrosions in the region of the intermediate space between rudder trunk and the wall of the receiving shaft and as a result, the connecting means already serves as a seal against seawater.

It is further preferred that the connecting means is disposed continuously over the entire clamping height. Consequently, in this embodiment no intermediate space or free space is provided between the lower end region and the upper end region of the clamping height which is not filled by the connecting means. The first part of the rudder trunk is therefore completely surrounded, i.e. over the entire circumference of the first part of the rudder trunk, by the connecting means over the entire clamping height and as a result completely connected to the wall of the receiving shaft over the entire clamping height.

It is also preferred that the intermediate space between the first part of the rudder trunk and the wall of the receiving shaft has a constant clearance at least over half of the clamping height. It is particularly preferred that the intermediate space between the first part of the rudder trunk and the wall of the receiving shaft has a constant clearance at least over two thirds of the clamping height or quite particularly preferably at least over three quarters of the clamping height. In principle, the receiving shaft or the wall of the receiving shaft can have any possible form of a shaft. For example, the receiving shaft could be configured in the form of a lift shaft and therefore formed by at least four walls or surfaces at an angle to one another. Preferably however the receiving shaft has the shape of a cylinder at least over the entire clamping height. Consequently the receiving shaft preferably has a circular cross-section in each region of the clamping height. As a result of the cylindrical embodiment of the receiving shaft in the region of the clamping height, the clearance of the intermediate space between the first part of the rudder trunk and the wall of the receiving shaft is not only constant at least over half of the clamping height but on the contrary is also completely, i.e. over the entire circumference of the rudder trunk, constant. The clearance of the intermediate space between the first part of the rudder trunk and the wall of the receiving shaft lies, for example, between 2 mm and 50 mm. The clearance preferably lies between 5 mm and 30 mm, particularly preferably the clearance lies between 10 mm and 20 mm. The relatively small clearance and the constant clearance over most of the clamping height has the advantage that the amount of the necessary connecting means can be kept relatively small.

Since the greatest bending moment occurs in the region of the skeg bottom, i.e. the lower edge of the skeg or in the lower end region of the receiving shaft, it is preferable to provide a shaping in the lower end region of the clamping height. Consequently, the intermediate space in the lower end region of the clamping height has a larger clearance than in the upper end region of the clamping height. It is therefore preferable that the intermediate space between the first part of the rudder trunk and the wall of the receiving shaft has a constant clearance over at least 75% of the clamping height, particularly preferably over at least 90% of the clamping height and only has a larger clearance in the lower end region of the clamping height. Quite particularly preferably the clearance increases in the lower end region of the clamping height when viewed from top to bottom. In order to achieve the simplest possible configuration of the receiving shaft, the clearance in the lower end region of the clamping height increases linearly when viewed from top to bottom. Consequently, the wall of the receiving shaft in the lower end region of the receiving shaft is slanted outwards or directed away from the rudder trunk. At least in the lower region of the clamping height, the receiving shaft therefore has the shape of an inverted funnel. Typically the clearance in the lower end region of the clamping height is between 15 mm and 100 mm. Since the clearance of the intermediate space in the lower end region of the clamping height is greater than in the upper end region of the clamping height, stress peaks can be avoided.

It is further preferred that the wall thickness of the rudder trunk in the upper end region of the clamping height has a lower thickness than in the lower end region of the clamping height. Preferably the outside diameter of the rudder trunk is substantially constant over the entire clamping height. Consequently, the inside diameter of the rudder trunk in the upper end region of the clamping height is preferably greater than in the lower end region of the clamping height. Accordingly, the wall thickness of the rudder trunk has a tapering, where the tapering of the wall thickness of the rudder trunk is directed from bottom to top and is achieved by a continuous enlargement of the inside diameter of the rudder trunk when viewed from bottom to top. This has the advantage that material for the manufacture of the rudder trunk can also be saved. Furthermore, as a result of the tapering of the wall thickness of the rudder trunk in the upper end region, the rudder trunk has a lower weight compared with conventional rudder trunks or rudder trunks having a constant wall thickness. Since the greatest introduction of force and in particular the largest bending moment occurs in the lower end region of the clamping height, it is nevertheless ensured that the rudder trunk has a sufficiently large wall thickness in this region. Since the tapering of the wall thickness of the rudder trunk is achieved through enlargement of the inside diameter and not by variation of the outside diameter of the rudder trunk, the clearance of the intermediate space between the first part of the rudder trunk and the wall of the receiving shaft can be kept constant in a relatively simple manner despite tapering of the rudder trunk.

It is further preferred that the rudder trunk does not have any fastening means projecting outwards from the rudder trunk, in particular fastening plates, fastening ribs or struts, for connecting the rudder trunk to the watercraft or in the receiving shaft, or to the wall of the receiving shaft. In contrast to rudder trunks known from the prior art, the rudder trunk according to the invention therefore has no plates or ribs or other outwardly projecting fastening means. The rudder trunk consequently consists merely of a tube, preferably a steel tube. Such a simple structure is not possible in known rudder trunks.

Preferably the receiving shaft is configured substantially as a tube or in a tubular manner at least in the entire region of the clamping height. Consequently, the rudder trunk in the region of the clamping height is disposed in a tube, i.e. the receiving shaft or in a tubular receiving shaft. Outside the region of the clamping height, in particular in the region above the clamping height, the receiving shaft can have any shape. For example, in this region above the clamping height the receiving shaft can be formed by a rectangular shape or by at least four surfaces disposed at an angle to one another. Furthermore, it would be possible that the receiving shaft is formed in this region by a hollow body having any shaping.

It is also preferred that the receiving shaft or the wall of the receiving shaft is firmly connected and preferably welded to the watercraft body or to the ship structure. The receiving shaft is therefore already provided at an appropriate location in the watercraft body during fabrication of the stern section. The receiving shaft can be fabricated as a separate component, then inserted and connected to the watercraft body or alternatively formed by special shaping of the plates or struts of the watercraft body in the stern section through the body of the watercraft or through the plates or strut. Preferably the wall of the receiving shaft is connected to the watercraft body in such a manner and through the connecting means to the rudder trunk that the receiving shaft is watertight.

It is further preferred that at least one means for sealing is provided between the first part of the rudder trunk, i.e. the part of the rudder trunk which is disposed in the receiving shaft, and the wall of the receiving shaft in the lower end region of the clamping height. Preferably the means for sealing is located in the lower end region of the clamping height below the connecting means. The connecting means expediently directly adjoins the means for sealing. On the other side or with the side facing away from the connecting means, the means for sealing terminates with the skeg bottom or with the lower edge of the skeg or the lower edge of the watercraft body. The means for sealing could, however, also be disposed below the lower edge of the skeg or the lower edge of the watercraft body. Particularly preferably the means for sealing is disposed in the region of a shaping of the receiving shaft in the lower region of the clamping height.

The means for sealing serves to protect the receiving shaft from below against ingress of seawater and other objects. Furthermore, the means for sealing serves to prevent any escape or outflow of the connecting means, in particular during the process of introduction of the connecting means into the intermediate space between the first part of the rudder trunk and the wall of the receiving shaft.

Particularly preferably the means for sealing as much as the connecting means comprises means for adhesive bonding. Consequently, the means for sealing not only serves to prevent the ingress of, for example, seawater or to prevent the escape of connecting means but also for connecting or for adhesive bonding of the rudder trunk to the wall of the receiving shaft in the lower end region of the clamping height. As a result in this embodiment the means for sealing is disposed in the region of the clamping height. Since the greatest forces or bending moments occur specifically in this lower end region of the clamping height, in this region the means for sealing additionally serve to increase the stability and to transmit the resulting forces into the watercraft body. Furthermore, a connecting means can therefore be provided as means for sealing. Here the means for sealing have similar properties to the connecting means, in particular adhesive properties. Preferably however, compared to the usually rather thinner-liquid connecting means, the means for sealing is viscous or has faster curing properties than the connecting means.

It is also preferred that both the rudder trunk and the wall of the receiving shaft comprise steel or particularly preferably consist of steel. In principle, the rudder trunk and the wall of the receiving shaft could consist of different materials. For example, it would be feasible that the rudder trunk consists of a fibre composite material, where the wall of the receiving shaft comprises steel or consists of steel or another suitable material.

The method according to the invention for manufacturing a maneuvering device for a watercraft, comprises the following steps:

1. inserting a rudder trunk into a receiving shaft, wherein a first part of the rudder trunk is disposed in the receiving shaft and a second part of the rudder trunk projects from the receiving shaft,
2. aligning the rudder trunk in the receiving shaft in such a manner that an intermediate space extends between the first part of the rudder trunk and the wall of the receiving shaft, wherein the intermediate space surrounds the entire circumference of the first part of the trunk,
3. introducing a connecting means into the intermediate space in such a manner that the connecting means is introduced against the gravitational force and that the connecting means completely, i.e. over the entire circumference of the first part of the trunk, connects the first part of the rudder trunk over a clamping height to the wall of the receiving shaft, wherein the connecting means is disposed at least in the lower end region and in the upper end region of the clamping height.

After inserting the rudder trunk in the receiving shaft, the rudder trunk is aligned by means of measuring devices and by means of alignment devices in the receiving shaft. In order to be able to move the rudder trunk freely during the alignment process, it is, for example suspended on steel cables or chains. The measuring device can, for example, comprise laser-optical alignment systems or other measuring systems. For the actual alignment, for example, adjusting units which can be connected to the ship structure or the hull under the skeg bottom or under the lower edge of the skeg or under the watercraft bottom for alignment purposes are used. Such an adjusting unit can, for example, consist of a steel block into which a threaded bolt is screwed. The rudder trunk is moved in the desired directed by turning this bolt. Furthermore, so-called lifting eyes can be provided, for example at the lower end of the rudder trunk, i.e. at the lower end of the second part of the rudder trunk, that is of the part of the rudder trunk projecting downwards from the receiving shaft. These can be fastened with steel cables or similar devices to other lifting eyes on the hull. The rudder trunk can be positioned or aligned in the X and Y direction by the adjusting unit. With the aid of the steel cables or the lifting eyes at the lower end of the rudder trunk, the installation height and the angle of the rudder trunk or the angle between the rudder trunk and the wall of the receiving shaft can be adjusted by lengthening or shortening these cables. With the help of these two alignment devices it is possible to align the rudder trunk within the receiving shaft in such a manner that the clearance of the intermediate space is substantially constant over the clamping height. Both alignment devices, the adjusting units at the skeg bottom as well as the lifting eyes are preferably removes after the assembly.

After the alignment process, the connecting means is introduced in the intermediate space between the rudder trunk or the first part of the rudder trunk and the wall of the receiving shaft against the gravitational force. For example, the connecting means is introduced into the intermediate space in the lower region of the clamping height and the column ascending in the intermediate space or the connecting means which is introduced from bottom to top into the intermediate space is monitored. The introduction process is stopped when the connecting means has filled the entire intermediate space above the clamping height to be determined beforehand. Alternatively, the connecting means could be introduced separately in the lower region of the clamping height and in the upper region of the clamping height.

Preferably before introducing the connecting means the intermediate space between the first part of the rudder trunk and the wall of the receiving shaft is sealed in the lower end region of the clamping height with at least one means for sealing. Since the connecting means is in a liquid or viscous state during the introduction, during the introduction process of the connecting means, the means for sealing in the lower end region of the clamping height serves to ensure that the connecting means does not flow out downwards from the intermediate space between rudder trunk and wall of the receiving shaft during the introduction but is firmly retained or positioned from below by the means for sealing and consequently the connecting means can rise upwards. The means for sealing can, for example, be a sealing ring or similar. Alternatively, the means for sealing could be formed from a particularly viscous connecting means with adhesive properties. This has the advantage that in this embodiment the means for sealing simultaneously serves as additional connecting means in the lower end region of the clamping height and therefore needs not to be removed again after the introduction process of the connecting means. Particularly preferably the means for sealing can have the same or very similar properties to the connecting means. Expediently, in contrast to the connecting means, the means for sealing has a firmer or more viscous property and hardens more rapidly than the connecting means.

It is further preferred that before introducing the connecting means, an opening is provided in the wall of the receiving shaft, where the opening is disposed in the lower third of the clamping height. In this case, an opening can, for example be drilled from the outside into the receiving shaft. After introducing the connecting means through the opening, this opening of the receiving shaft is closed again, preferably welded. Alternatively, the opening can also be provided in the region of the means for sealing. It is also possible to provide the opening directly in the means for sealing.

Preferably the connecting means is pumped into the intermediate space between the first part of the rudder trunk and the wall of the receiving shaft by a pumping process. The connecting means is therefore pumped from bottom to top into to the intermediate space between rudder trunk and the wall of the receiving shaft.

Figure 2:
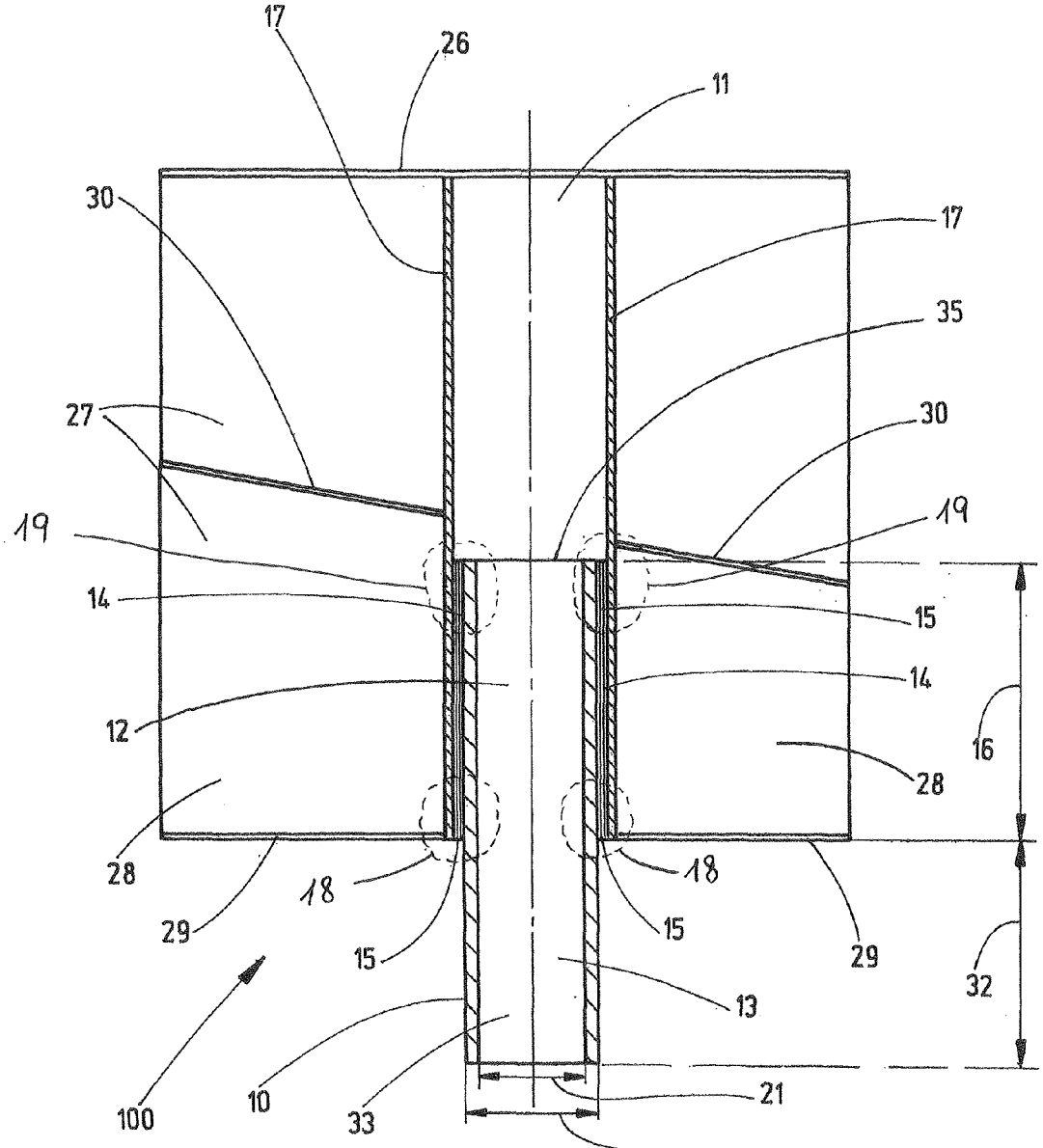
Figure 3:
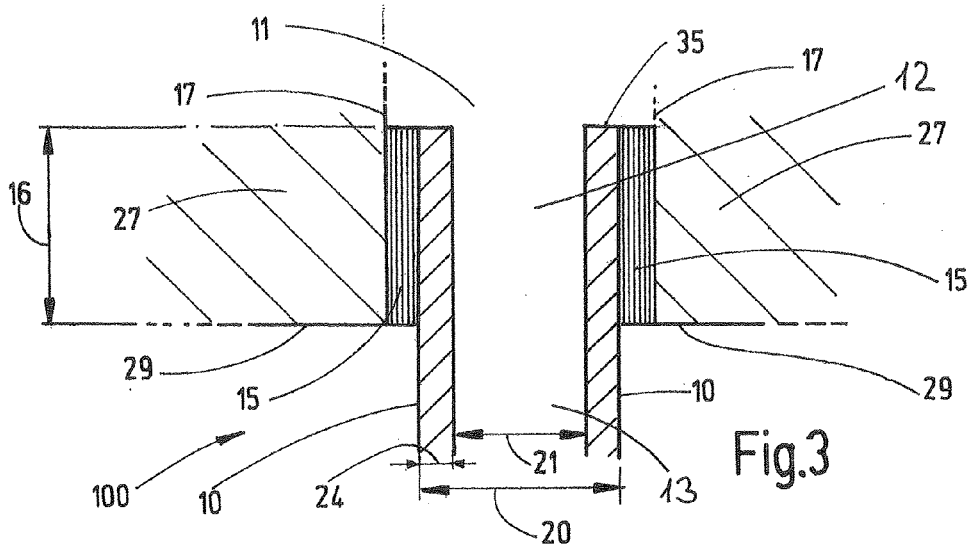
Figure 4:
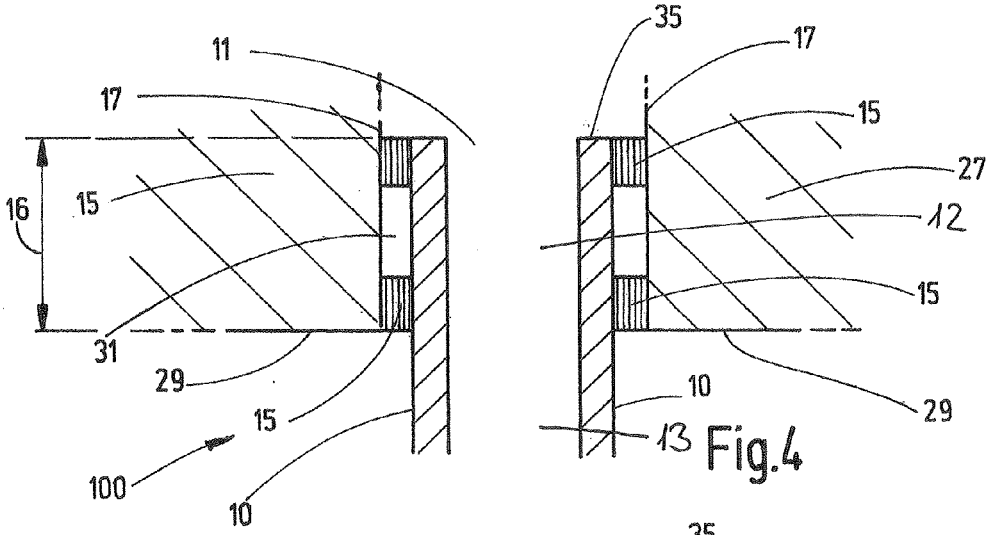
Figure 5:
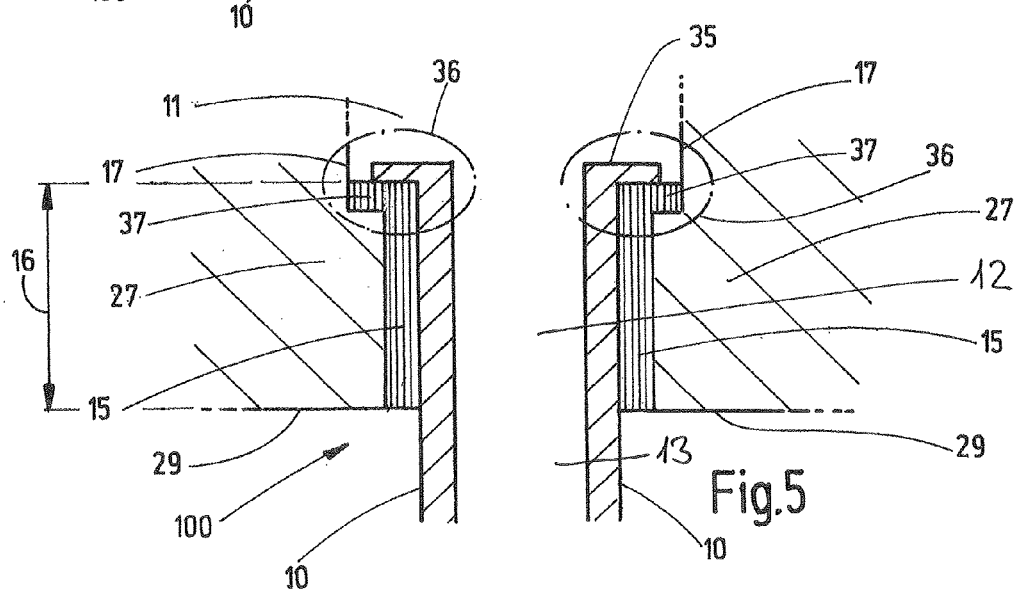
Figure 6:
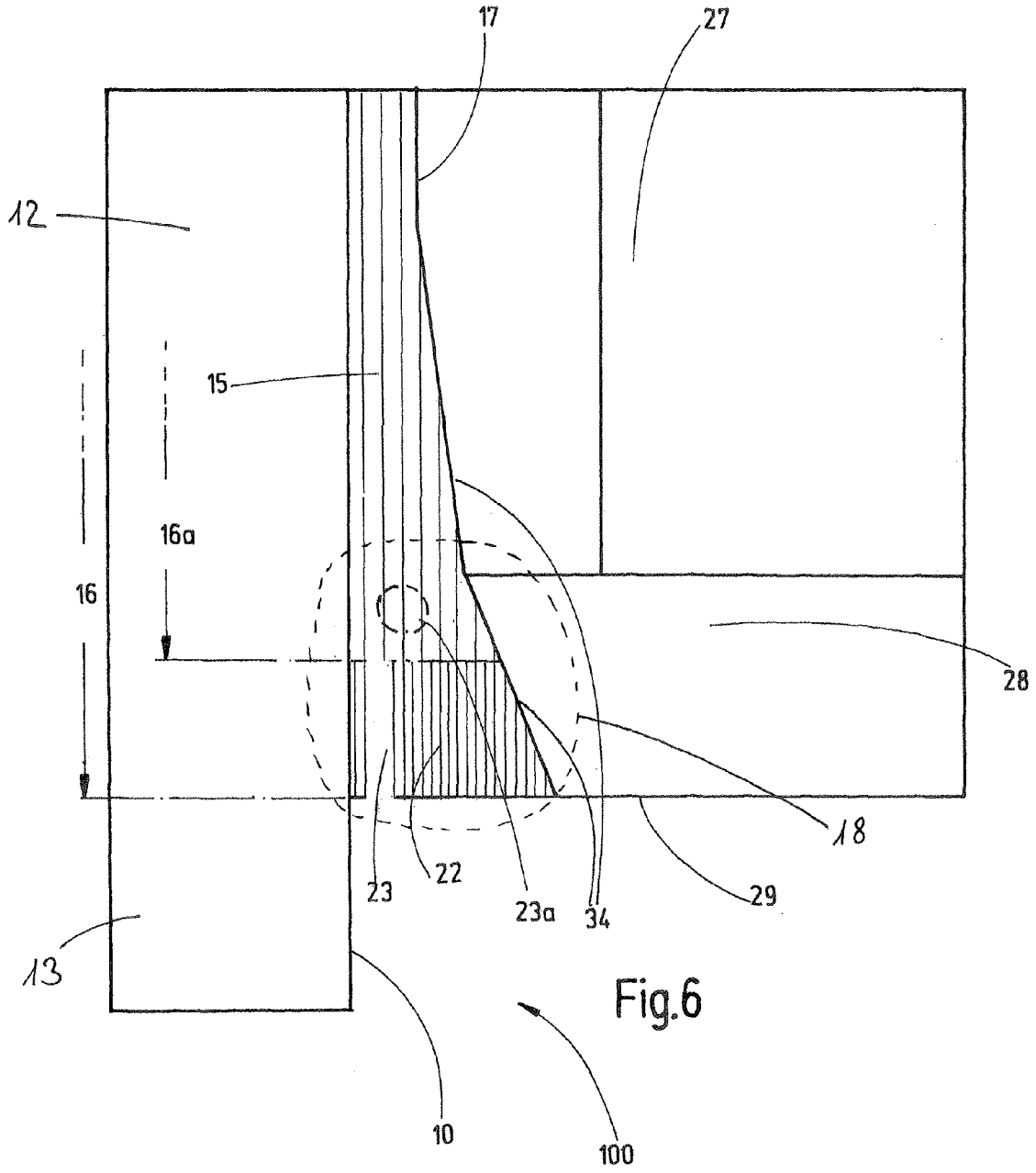

The invention is now explained with reference to the accompanying drawings by means of particularly preferred embodiments as an example. In the figures:

FIG. 1 shows a rudder trunk as is known from the prior art and usually used, FIG. 2 shows a cross-section of a device for maneuvering according to the invention, FIG. 3 shows a cross-section of a part region of a device for maneuvering according to the invention, where the connecting means is disposed continuously over the entire clamping height, FIG. 4 shows a further cross-section of a part region of a device for maneuvering according to the invention, where the connecting means is disposed in the upper end region of the clamping height and in the lower end region of the clamping height, FIG. 5 shows a further cross-section of a part region of a device for maneuvering according to the invention, where a loss-prevention device with band is provided, and FIG. 6 shows a further cross-section of a part region of a device for maneuvering according to the invention, where the clearance between rudder trunk and the wall of the receiving shaft increases in the lower end region of the clamping height.

FIG. 2 shows a device 100 for maneuvering a watercraft according to the invention, in cross-section. In contrast to the rudder trunk 10 known from the pri- or art and shown in FIG. 1, the rudder trunk 10 of the device 100 for maneuvering according to the invention, merely consists of a tube, in particular a steel tube. Compared to the rudder trunk 9 shown in FIG. 1, the rudder trunk 10 has no connecting means, in particular no outwardly projecting connecting means such as, for example, fastening plates, connection plates 25, fastening ribs or struts. The rudder trunk 10 of the device 100 for maneuvering a watercraft according to the invention is disposed with its first part 12, the upper part of the rudder trunk 10, in the receiving shaft 11. The second part 13, the lower part of the rudder trunk 10, projects from the receiving shaft 11 downwards. The receiving shaft 11 can have any arbitrary shape. Preferably the receiving shaft 11, as shown in FIG. 2, is configured in such a manner that it possesses a substantially circular cross-section and has the shape of a cylinder or a cylinder-like shape. The receiving shaft 11 extends from the rudder engine deck 26 from top to bottom through the stern structure 27 as far as the lower edge of the stern structure or as far as the lower edge of the skeg 29. Consequently, the receiving shaft 11 extends from top to bottom through the stern structure 27, where the skeg 28 is seen as a part of the stern structure 27. Depending on the requirement for the rudder systems, the rudder trunk 10 is introduced into the receiving shaft 11 with a predefined height. The rudder trunk 10 of the device 100 for maneuvering a watercraft according to the invention need not be disposed up to the top towards the rudder engine deck 26 as rudder trunks 10 known from the prior art. For example, as shown in FIG. 2, the rudder trunk 10 can be disposed with its first part 12 only in the region of the skeg 28 in the receiving shaft 11. Consequently, the part above the rudder trunk 10 in the receiving shaft 11 up to the top towards the rudder engine deck 26 is empty.

The rudder trunk 10 shown in FIG. 2 is glued in the receiving shaft 11 by means of a connecting means 15. To this end the connecting means 15, for example, an epoxide-based casting material, is disposed in the intermediate space 14 between the rudder trunk 10 and the receiving shaft 11. As shown in FIG. 2, the connecting means 15 can be disposed around the entire circumference of the first part 12 of the rudder trunk 10 and over the entire height of the first part 12 of the rudder trunk 10. However, it would also be feasible to dispose the connecting means 15 only over a part of the height of the first part 12 of the rudder trunk 10. The height over which the connecting means 15 is disposed in the intermediate space 14 between rudder trunk 10 and the wall 17 of the receiving shaft 11 (in the exemplary embodiment from FIG. 2 also corresponds to the length of the first part 12 of the rudder trunk 10) is the same as the clamping height 16. Since, as shown in FIG. 2, the connecting means 15 is disposed over the entire clamping height 16 and consequently the rudder trunk 10 is adhesively connected to the wall 17 of the receiving shaft 11 over the entire clamping height 16, a uniform stress distribution is achieved over the entire clamping height 16 and an approximately 100% force fit between the parts to be joined.

The length ratio of the clamping height 16 to the second part 13 of the rudder trunk 10, that is the part which projects downwards from the receiving shaft 11, is at least 1. This means that the clamping height 16 is at least as long as the second part 13 of the rudder trunk 10. Depending on the requirements for the rudder system, however, the clamping height 16 can be considerably longer than the second part 13 of the rudder trunk 10. For example, the clamping height 16 can be a multiple of the length of the second part 13 of the rudder trunk 10. It is feasible, for example, that the clamping height 16 is twice or even three to four times longer than the length of the second part 13 of the rudder trunk 10 projecting downwards from the receiving shaft 11.

The figures are not drawn to scale but it is clearly shown in FIG. 2 that the clamping height 16 is longer than the second part 13 of the rudder trunk 10.

The receiving shaft 11 of the device for maneuvering a watercraft according to the invention can be fabricated at the shipyard and provided in the stern structure 27 or built into this, e.g. welded in. Since the rudder trunk 10 of the device for maneuvering a watercraft according to the invention no longer necessarily needs to be disposed over the entire length or the entire distance between rudder engine deck 26 and rudder hub, like rudder trunks known from the prior art and shown as an example in FIG. 1, rudder trunks 10 having a shorter length and a lower weight can be fabricated. Consequently, considerable costs for material, transport and handling with the rudder trunks 10 can be saved. Since the rudder trunk 10 of the device 100 for maneuvering a watercraft according to the invention has no fastening plates or ribs, connecting plates 25 or struts for a connection to the ship, but is merely adhesively bonded in the receiving shaft 11, the expenditure for the manufacture and for the installation of such a device 100 for maneuvering a watercraft according to the invention can be reduced appreciably.

FIGS. 3 to 5 each show the same part region of various devices 100 for maneuvering a watercraft according to the invention in cross-section. In particular, FIGS. 3 to 5 show that region in which the rudder trunk 10 is disposed with its first part 12 in the receiving shaft 11.

FIG. 3 shows that the rudder trunk 10 is fastened over the entire circumference of the first part of the rudder trunk and continuously over the entire clamping height 16 by means of a connecting means 15 in the receiving shaft 11 or is connected to the wall 17 of the receiving shaft 11. In the variant shown in FIG. 3, the first part 12, that is the part of the rudder trunk 10 which is disposed inside the receiving shaft 11, corresponds to the clamping height 16, that is the height over which the rudder trunk 10 is glued in the receiving shaft 11. However, it would also be feasible that the first part 12 of the rudder trunk 10 is longer than the clamping height 16. In this case, the upper region of the connecting means 15 in the intermediate space 14 between rudder trunk 10 and the wall 17 of the receiving shaft 11 would not terminate exactly with the upper edge 35 of the rudder trunk 10. The rudder trunk 10 could therefore be arranged freely with one part in the receiving shaft 11 where the clamping height 16 begins at the lower edge of the stern structure 27 or the lower edge 29 of the skeg 28 and does not reach as far as the upper edge of the first part 12 of the rudder trunk 10. Whilst pumping in the connecting means 15, the intermediate space 14 between rudder trunk 10 and the wall 17 of the receiving shaft 11 in the upper end region of the clamping height 16 is usually monitored so that the pumping-in process can be stopped at the correct time and the connecting means 15 does not flow into the rudder trunk tube. For example, the connecting means 15 is pumped into the intermediate space 14 in an ascending manner from below until it emerges from vent holes provided in the upper region of the clamping height 16.

FIG. 4 shows another variant as to how the connecting means 15 can be disposed between rudder trunk 10 and the wall 17 of the receiving shaft 11. As shown in FIG. 4, the connecting means 15 is disposed at least in the lower end region and in the upper end region of the clamping height 16. In this case, unlike the variant shown in FIG. 3, a free intermediate space or free space 31 is formed between the connecting means 15 which is disposed in the lower end region of the clamping height 16 and the connecting means 15 which is disposed in the upper end region of the clamping height 16. In each case the clamping height 16 is defined in such a manner that it comprises the entire height over which the rudder trunk 10 inside the receiving shaft 11 is connected to the wall 17 of the receiving shaft 11. The clamping height 16 therefore comprises a possible free space 31 between connecting means 15. Consequently, the clamping height 16 in FIG. 3 and FIG. 4 is identical. Whilst pumping in the connecting means 15, the intermediate space 14 between rudder trunk 10 and the wall 17 of the receiving shaft 11 in the upper end region of the clamping height 16 is usually monitored so that the pumping-in process can be stopped at the correct time and the connecting means 15 does not flow into the rudder trunk tube. For example, the connecting means 15 is pumped into the intermediate space 14 in an ascending manner from below until it emerges from vent holes provided in the upper region of the clamping height 16.

FIG. 5 shows another variant of the adhesive bonding of the rudder trunk 10 in the receiving shaft 11. In the variant shown in FIG. 5 a loss prevention device 36 is provided. In the upper end region of the clamping height 16 the receiving shaft 11 has a recess 37 or a larger diameter. Furthermore, as shown in FIG. 5, the upper region of the rudder trunk 10 can be angled or bent outwards. By providing such a loss prevention device 36, it can be avoided that when pumping in the connecting means 15 from bottom to top in the intermediate space 14 between rudder trunk 10 and the wall 17 of the receiving shaft 11, the connecting means 15 in the upper region of the clamping height 16 flows over the upper edge 35 of the rudder trunk 10. Whilst pumping in the connecting means 15, the intermediate space 14 between rudder trunk 10 and the wall 17 of the receiving shaft 11 in the upper end region of the clamping height 16 is usually monitored so that the pumping-in process can be stopped at the correct time and the connecting means 15 does not flow into the rudder trunk tube. For example, the connecting means 15 is pumped into the intermediate space 14 in an ascending manner from below until it emerges from vent holes provided in the upper region of the clamping height 16. The provision of a loss prevention device 36 as shown for example in FIG. 5 provides another possibility for preventing the connecting means 15 from exceeding the provided clamping height 16 too rapidly.

FIG. 6 shows another cross-section of a section of a device 100 for maneuvering a watercraft according to the invention. In particular, FIG. 6 shows another possible configuration of the lower end region of the clamping height 16 or of the receiving shaft 11 in the lower end region of the clamping height 16. The configuration of the receiving shaft 11 must be designed in such a manner that the forces and moments can be transferred optimally to the surrounding structure of the watercraft or of the ship. In addition to the composition of the connecting means 15, the clearance of the intermediate space 14 between rudder trunk 10 and the wall 17 of the receiving shaft 11 is an important parameter. The clearance is usually dependent on the requirements on the device, for example, rudder system and on the material used. The clearance of the intermediate space 14 between rudder trunk 10 and the wall 17 of the receiving shaft 11 is preferably substantially constant. Furthermore, the clearance should not be too large, so that the costs for the connecting means 15, which are primarily dependent on the amount of connecting means 15 to be used, can be kept low.

Tests have shown that, for example, with a rudder trunk length of about 5 m, where the clamping height 16 is at least half the length of the entire rudder trunk length, the clearance can be in the range between 10 mm and 20 mm. Tests have further shown that in particular a clearance of at least 15 mm is sufficient to meet the requirements for the device. The use of a constant clearance over the substantial region of the clamping height 16 has the advantage that both a minimal clearance is ensured at each point and also excessively large clearances at individual points are avoided. In the event that the clearance at individual points is particularly large, the amount of connecting means 15 required and therefore the costs for the connecting means 15 would be increased unnecessarily. Furthermore, with a non-constant clearance, the determination of the required amount of connecting means 15 in advance would be intricate.

Since the largest forces, e.g. the largest bending moments occur in the lower end region of the clamping height 16, for example in the region of the skeg bottom, or the lower edge 29 of the skeg 28, it is advantageous to provide a larger clearance in this region, as shown in FIG. 6. For example a shaping 34 can be provided in the lower region of the receiving shaft 11. Consequently, this region has a larger clearance compared with the region located thereabove and provides a larger space for receiving the connecting means 15. By providing a larger clearance of the intermediate space 14 between rudder trunk 10 and the wall 17 of the receiving shaft 11 in the lower end region of the clamping height 16, stress peaks can be avoided or reduced.

A shaping 34 of the receiving shaft 11 in the lower end region of the clamping height 16 can be achieved in various ways. As shown in FIG. 6, the clearance in the lower end region of the clamping height 16 increases when viewed from top to bottom. Preferably, as shown in FIG. 6, the wall 17 of the receiving shaft 11 is configured to be oblique in the lower end region of the clamping height 16 or inclined towards the outside in such a manner that the clearance increases linearly when viewed from top to bottom.

The connecting means 15 which is introduced into the intermediate space 14 between rudder trunk 10 and the wall 17 of the receiving shaft 11 for adhesive bonding can have different properties in the lower end region 18 of the clamping height 16 and in particular in the region of the shaping 34. For example, it is possible to provide a connecting means 15 and a means for sealing 22 with different properties in the intermediate space 14 between rudder trunk 10 and the wall 17 of the receiving shaft 11. A means for sealing 22 having particularly viscous properties and/or fast-curing properties could be disposed in the lower terminating region of the intermediate space 14, i.e. in the lower end region 18 of the clamping height 16 in the region of the lower edge 29 of the ship structure or the skeg bottom. Such a means for sealing 22 having viscous and/or fast-curing properties is provided for closing the gap in the region of the lower edge 29 of the ship structure or the skeg bottom before introducing the remaining connecting means 15 into the intermediate space 14. After curing of the means for sealing 22, the remaining connecting means 15 is pumped into the intermediate space 14 between rudder trunk 10 and the wall 17 of the receiving shaft 11. As a result of the viscous or fast-curing means for sealing 22 provided previously, the receiving shaft 11 is already sealed in the lower region and prevents any escape of the remaining connecting means 15 during the pumping-in process. In addition, the means for sealing 22 provided for sealing can be used not only for sealing but can also having adhesive properties and as a result additionally also be used for joining the rudder trunk 10 to the wall 17 of the receiving shaft 11. This has the advantage that no alternative means for sealing need be provided and the means for sealing 22 also ensures a nonpositive fit in this region between rudder trunk 10 and the wall 17 of the receiving shaft 11 and consequently is also used for the transmission of forces or the bending moment. An alternative means for sealing which has no adhesive effect could, for example, be a rubber seal which is arranged instead of the means for sealing 22 in the region of the shaping 34 of the receiving shaft 11 or below the lower edge 29 of the skeg.

It is further shown in FIG. 6 that the clamping height 16, 16*a* comprises the height over which the rudder trunk 10 is connected to the wall 17 of the receiving shaft 11. In the event that the means for sealing 22 also has joining properties, the clamping height 16 comprises the entire height, that is the height over which the connecting means 15 and the means for sealing 22 are disposed. When using an alternative means for sealing, i.e. a means for sealing without joining properties or adhesive properties, the clamping height 16*a* merely comprises the height over which the connecting means 15 is disposed, excluding the height of the means for sealing 22. Since only a section of the device 100 for maneuvering a watercraft according to the invention is shown in FIG. 6, only the lower end region of the clamping height 16, 16*a* and not its entire length is shown.

Furthermore, FIG. 6 shows two embodiments for providing an opening 23, 23*a*. In both embodiments the opening 23, 23*a* is provided in the lower third of the clamping height 16, 16*a*. In one embodiment the opening 23*a* is provided in the wall 17 of the receiving shaft 11. In a second embodiment the opening 23 is provided in the means for sealing 22. The arrangement of the opening 23, 23*a* is independent of whether the means for sealing 22 additionally has joining properties or adhesive properties. Usually only one opening 23 or 23*a* is provided for the pumping-in process.

The invention claimed is:

1. A device for maneuvering a watercraft, comprising:

a rudder trunk and a receiving shaft;

wherein a first part of the rudder trunk is disposed in the receiving shaft in such a manner that there is an intermediate space between a first part of the rudder trunk and a wall of the receiving shaft, and a second part of the rudder trunk projects from the receiving shaft;

wherein the intermediate space is filled with a connecting means at least in certain areas;

wherein the connecting means attaches the first part of the rudder trunk to the wall of the receiving shaft over a clamping height;

wherein the connecting means is disposed at least in a lower end region of the clamping height and in an upper end region of the clamping height; and characterised in that the connecting means is disposed surrounding an entire circumference of the first part of the rudder trunk;

wherein the length ratio between the clamping height and the second part of the rudder trunk is at least 1; and wherein the intermediate space in the lower end region of the clamping height has a larger clearance than in the upper end region of the clamping height.

2. The device according to claim 1, characterised in, that the connecting means comprises means for adhesive bonding.

3. The device according to claim 1, wherein the length ratio between the clamping height and the second part of the rudder trunk is between 1 and 3.

4. The device according to claim 3, wherein the length ratio between the clamping height and the second part of the rudder trunk is between 1 and 2.

5. The device according to claim 1, characterised in that the connecting means is disposed continuously over the entire clamping height.

6. The device according to any of claim 1, 2 or 5, characterised in, that the intermediate space between the first part of the rudder trunk and the wall of the receiving shaft has a constant clearance at least over half the clamping height.

7. The device according to any one of claim 1, 2 or 5, characterised in, that the clearance in the lower end region of the clamping height increases when viewed in the direction from the upper end region to the lower end region.

8. The device according to any one of claim 1, 2 or 5, characterised in, that the rudder trunk has a wall thickness, wherein the wall thickness in the upper end region of the clamping height has a smaller thickness than in the lower end region of the clamping height.

9. The device according to any one of claim 1, 2 or 5, characterised in, that the rudder trunk has an outside diameter, wherein the outside diameter is substantially constant.

10. The device according to any one of claim 1, 2 or 5, characterised in, that the rudder trunk has an inside diameter, wherein the inside diameter in the upper end region of the clamping height is greater than in the lower end region of the clamping height.

11. The device according to any one of claim 1, 2 or 5, characterised in, that the rudder trunk has no fastening means projecting outwards from the rudder trunk, in the form of fastening plates, connecting plates or fastening ribs, for connecting the rudder trunk to a watercraft or the receiving shaft.

12. The device according to any one of claim 1, 2 or 5, characterised in, that the receiving shaft is configured substantially as a tube or in tubular manner at least in the entire region of the clamping height.

13. The device according to any one of claim 1, 2 or 5, characterised in, that the wall of the receiving shaft is firmly connected to a watercraft body.

14. The device according to any one of claim 1, 2 or 5, characterised in, that the wall of the receiving shaft is connected to the watercraft body, and by means of the connecting means to the rudder trunk in such a manner that the receiving shaft is watertight.

15. The device according to any one of claim 1, 2 or 5, characterised in, that at least one means for sealing is disposed between the first part of the rudder trunk and the wall of the receiving shaft in the lower end region of the clamping height.

16. The device according to any one of claim 1, 2 or 5, characterised in, that the rudder trunk and the wall of the receiving shaft comprise steel or steel materials.

17. The device according to claim 6, characterised in that the intermediate space between the first part of the rudder trunk and the wall of the receiving shaft has a constant clearance of at least over ⅔ of the clamping height.

18. The device according to claim 17, characterised in that the intermediate space between the first part of the rudder trunk and the wall of the receiving shaft has a constant clearance of at least over ¾ of the clamping height.

19. The device according to claim 15, characterised in that the means for sealing comprises means for adhesive bonding.

20. A method for manufacturing a maneuvering device for a watercraft, comprising the following steps:

a) inserting a rudder trunk into a receiving shaft, wherein a first part of the rudder trunk is disposed in the receiving shaft and a second part of the rudder trunk projects from the receiving shaft;

b) aligning the rudder trunk in the receiving shaft in such a manner that an intermediate space extends between the first part of the rudder trunk and a wall of the receiving shaft, wherein the intermediate space surrounds an entire circumference of the first part of the trunk; and c) introducing a connecting means into the intermediate space in such a manner that the connecting means is introduced against a gravitational force and that the connecting means completely, connects the first part of the rudder trunk over a clamping height to the wall of the receiving shaft, wherein the connecting means is disposed at least in a lower end region and in an upper end region of the clamping height.

21. The method according to claim 20, characterised in, that before introducing the connecting means the intermediate space between the first part of the rudder trunk and the wall of the receiving shaft is sealed in the lower end region of the clamping height with at least one means for sealing.

22. The method according to one of claim 20 or 21, characterised in, that before introducing the connecting means an opening is provided in the wall of the receiving shaft or in the means for sealing-, wherein the opening is disposed in the lower third of the clamping height, wherein the opening is preferably closed after introducing the connecting means.

23. The method according to claim 20, characterised in, that the connecting means is introduced by pumping into the intermediate space.

* * * * *